US008166898B2

(12) United States Patent
Chen

(10) Patent No.: US 8,166,898 B2
(45) Date of Patent: May 1, 2012

(54) WIND-POWERED PERSONAL HYDROFOIL WATERCRAFT

(75) Inventor: Shane Chen, Camas, WA (US)

(73) Assignee: Shane Chen, Camas, WA (US)

( * ) Notice: Subject to any disclaimer, the term of this patent is extended or adjusted under 35 U.S.C. 154(b) by 268 days.

(21) Appl. No.: 12/549,304

(22) Filed: Aug. 27, 2009

(65) Prior Publication Data

US 2010/0050916 A1 Mar. 4, 2010

Related U.S. Application Data

(60) Provisional application No. 61/092,702, filed on Aug. 28, 2008.

(51) Int. Cl.
*B63H 9/00* (2006.01)

(52) U.S. Cl. ..... 114/39.15; 114/39.24; 114/281; 114/91

(58) Field of Classification Search ..... 114/39.15, 114/39.24, 281, 91
See application file for complete search history.

(56) References Cited

U.S. PATENT DOCUMENTS

| | | | | |
|---|---|---|---|---|
| 3,747,138 | A * | 7/1973 | Morgan | 441/74 |
| 4,508,046 | A * | 4/1985 | Coulter et al. | 114/39.15 |
| 4,711,195 | A * | 12/1987 | Shutt | 114/274 |
| 4,715,304 | A * | 12/1987 | Steinberg | 114/280 |
| 5,410,977 | A * | 5/1995 | Webb | 114/91 |
| 6,468,118 | B1 * | 10/2002 | Chen | 440/21 |
| 7,047,901 | B2 * | 5/2006 | Chen | 114/281 |

* cited by examiner

*Primary Examiner* — Stephen Avila

(57) ABSTRACT

A personal wind-powered hydrofoil watercraft having a sail supported by a mast coupled to a buoyant body, where the mast is tiltable forward and backward but not side to side, in order to prevent excessive rolling of the buoyant body when it is lifted clear of the water on the hydrofoils. Additionally, the buoyant body may be in the shape of a pontoon, the watercraft may be steerable by a steering mechanism actuated by a human operator's foot or feet, and the front hydrofoil may be associated with a surface tracking means in order to stabilize the altitude of the watercraft.

7 Claims, 2 Drawing Sheets

WIND-POWERED PERSONAL HYDROFOIL WATERCRAFT

CROSS-REFERENCE TO RELATED APPLICATIONS

This application claims the benefit of provisional patent application No. 61/092,702, filed Aug. 28, 2008 by the present inventor.

BACKGROUND

1. Field

This application relates to sailboards or windsurfing apparatus, specifically to those equipped with hydrofoils for providing vertical lift.

2. Prior Art

Numerous attempts have been made to equip a sailboard or windsurfing apparatus with hydrofoils providing vertical lift. The purpose of this is to reduce the effect of small waves and chop, which makes the ride smoother. In addition to being more comfortable for the user, a smoother ride could potentially enable higher speeds to be reached due to the lessened interference from water surface disturbances. Hydrofoils, along with their supporting structures, may also experience less drag than planing boards, though this is not guaranteed for all designs.

Some implementations of the hydrofoil sailboard concept are disclosed in U.S. patents, early examples of which are U.S. Pat. No. 4,508,046 (1985) and U.S. Pat. No. 4,715,304 (1987). Most designs use two hydrofoils mounted respectively at the front and the rear of the board. These hydrofoil sailboards tend to suffer from greater lateral instability compared to non-hydrofoil sailboards, because while the board is lifted clear of the water the hydrofoils and their supporting structures provide less resistance to rolling than a planing board does. Since the mast foot is a universal joint capable of tilting in any direction, the only way to prevent the board from rolling excessively is by careful control on the part of the user. This makes hydrofoil windsurfing much more difficult than conventional windsurfing. Thus the addition of hydrofoils has tended to result in increased difficulty of use, to an extent disproportionate to its advantages. This is likely the reason hydrofoil sailboards have not come into use and have not been sustainable as a marketed product.

One popular configuration of hydrofoils is known as the canard configuration, which comprises a hydrofoil for providing most of the vertical lift, and a surface tracking body capable of planing on the surface, the surface tracking body is positioned forward of the hydrofoil and connected to the hydrofoil through a arm, such that the angle of attack of the hydrofoil is continuously adjusted in order to maintain an approximately constant altitude. This configuration has been used in various watercraft, including U.S. Pat. No. 6,468,118 by the present inventor.

Incidentally, since a hydrofoil sailboard is intended to be lifted on the hydrofoils during normal operation, it is unnecessary for the buoyant body to be board shaped, and the width required to achieve that shape becomes superfluous.

DRAWINGS

Figures

DRAWINGS

Reference Numerals

Figure 1:
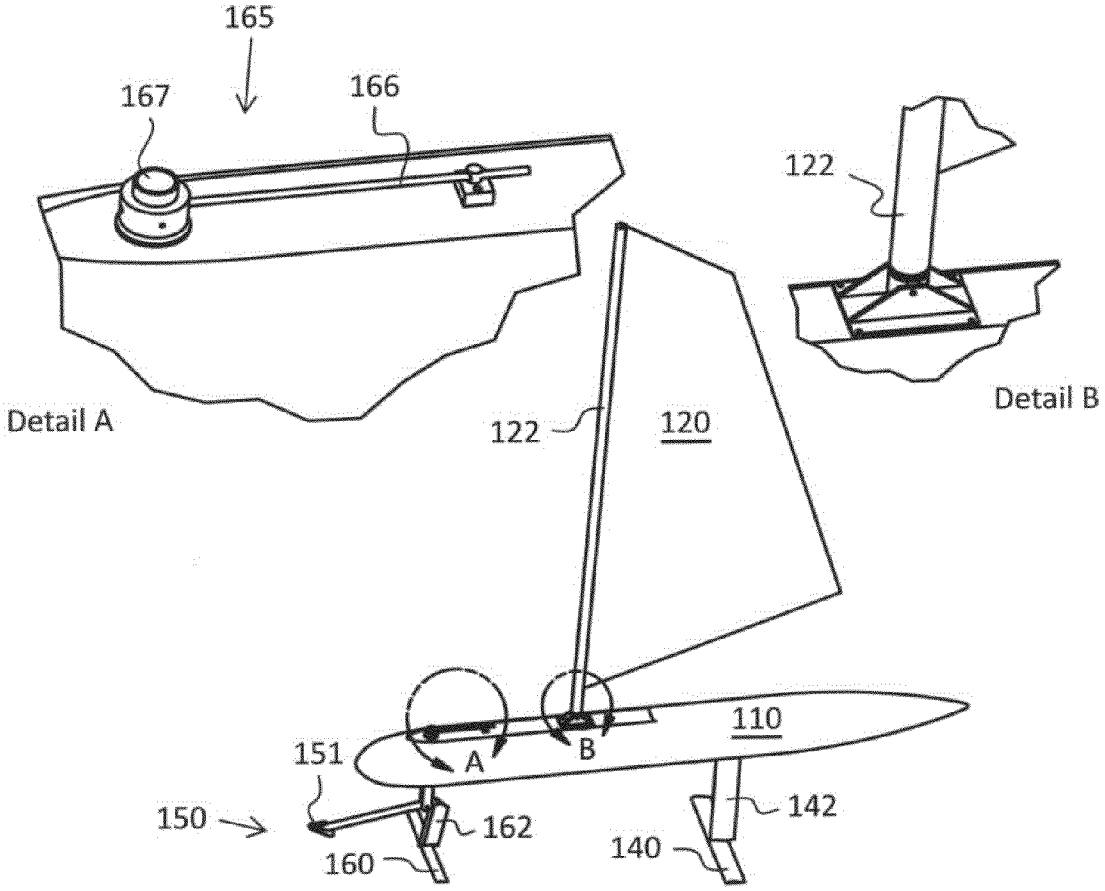
FIG. 1 shows a perspective view of a wind-powered personal hydrofoil watercraft with a joint having a single axis of tiltability, and a surface tracking front hydrofoil arrangement in accordance with one embodiment. Details A and B respectively show a bias mechanism for vertical pivoting of the front hydrofoil assembly and said tiltable joint in accordance with this embodiment.
Figure 2:
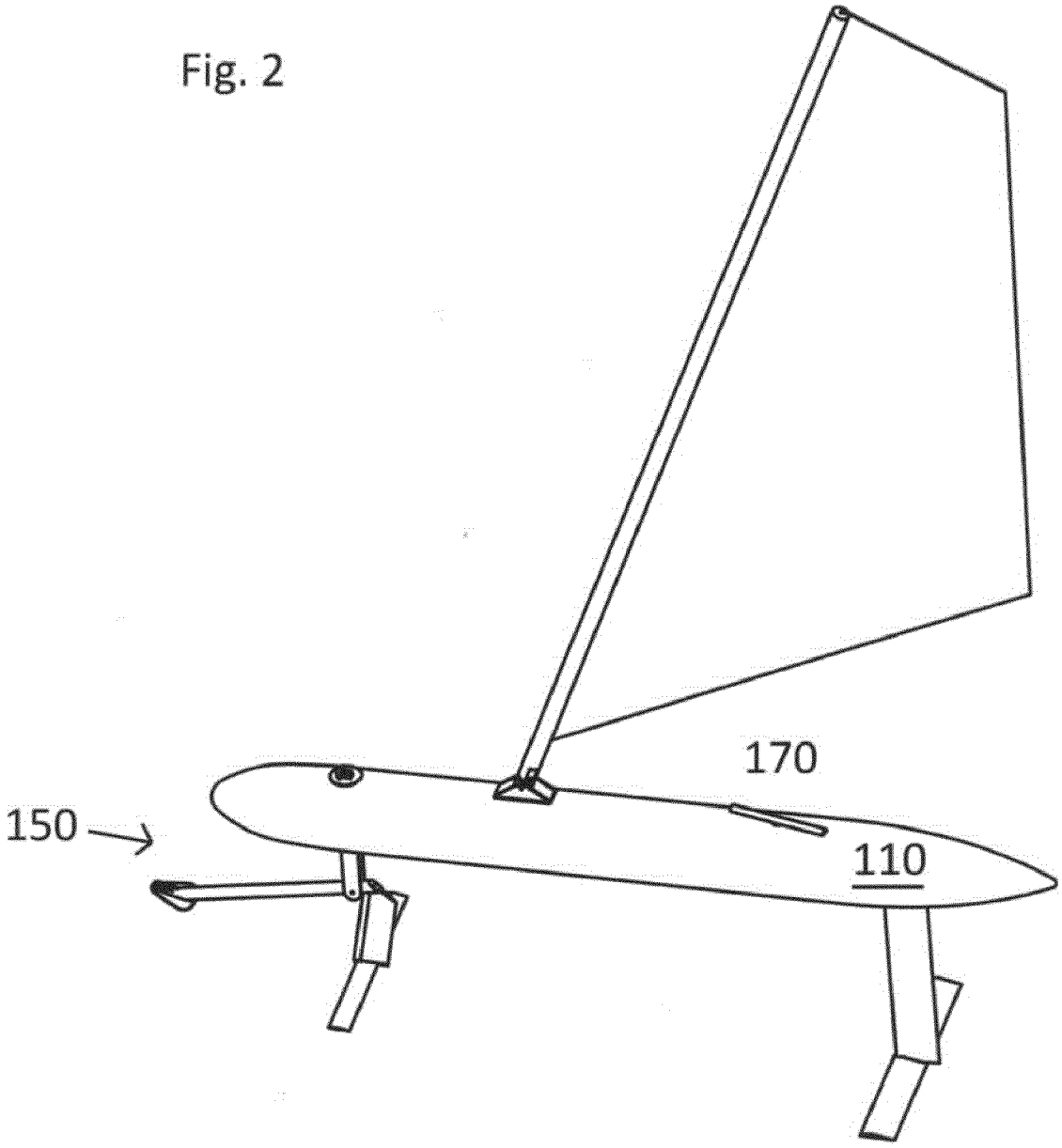
FIG. 2 shows a perspective view of a wind-powered personal hydrofoil watercraft similar to FIG. 1 but further comprising a foot-controlled steering bar, in accordance with another embodiment.

110 pontoon
120 sail
122 mast
124 joint
140 rear hydrofoil
142 rear strut
150 front hydrofoil assembly
151 surface tracking body
160 front hydrofoil
162 front strut
165 bias mechanism
166 bias rod
167 bias shaft
170 steering mechanism

DETAILED DESCRIPTION

One embodiment is illustrated in FIG. 1. The hydrofoil windsurfing apparatus of this embodiment comprises a buoyant body or pontoon 110, a sail 120 supported by a mast 122, a rear hydrofoil 140, and a front hydrofoil assembly 150. Pontoon 110 is in the form of a cylinder tapered and/or rounded at both ends. Its length is within the range of conventional windsurfing board lengths, and its width is sufficient to accommodate a human user standing sideways. Pontoon 110 can be made from the same materials as windsurfing boards and by the same or similar methods; these materials and methods are known in the art.

Sail 120 and mast 122 may be any sail and mast used in conventional windsurfing. Mast 122 is detachably coupled to pontoon 110 by means of a joint 124. Unlike the universal joint commonly used on a sailboard, joint 124 does not allow the mast to tilt in every direction. Instead joint 124 is pivotable only toward the front and the back of pontoon 110, restricting mast 122 to a generally vertical plane parallel to the longitudinal axis of pontoon 110.

Rear strut 142 is coupled to the undersurface of pontoon 110 and to the rear. Rear hydrofoil 140 is a horizontally disposed hydrofoil rigidly coupled to rear strut 142 and perpendicular to pontoon 110. Rear hydrofoil 140 is most effective when made of aluminum, carbon fiber, or fiberglass. If aluminum, rear hydrofoil 140 is efficiently fabricated by extrusion, which gives it a uniform cross section throughout its entire length. Carbon fiber and fiberglass hydrofoils are commercially available. Rear strut 142 is also a hydrofoil, its shape serving to reduce drag.

Front hydrofoil assembly 150 is pivotably coupled to the front of pontoon 110, such that pivoting is possible both about a vertical axis, and about a horizontal axis disposed perpendicularly to pontoon 110. Front hydrofoil assembly 150 comprises a surface tracking body 151, which is reasonably lightweight and has a generally flat bottom surface such that it remains generally at the surface of the water when moving at or above a certain speed. Front hydrofoil assembly 150 further comprises a front hydrofoil 160 rigidly coupled to a front strut 162. Thus the angle of attack of front hydrofoil 160 is controlled by the altitude of surface tracking body 151, whereby the altitude of the entire watercraft is regulated without requiring constant adjustment by the human user. Furthermore, front strut 162 is disposed to the rear of the vertical pivoting axis of front hydrofoil assembly 150. This configuration prevents front hydrofoil assembly 150 from accidentally turning to face backwards.

A steering mechanism 170 is provided on pontoon 110. Steering mechanism 170 comprises a steering bar, mounted on the exterior of pontoon 110 such that it is near the feet of a user standing on pontoon 110 in normal sailing position. The steering bar is an elongated member that lies parallel to the longitudinal axis of pontoon 110 but is capable of pivoting about a vertical axis to a certain degree. It is operatively coupled to front hydrofoil assembly 150, possibly by means of cables on the interior of pontoon 110.

A bias mechanism 165 is also provided on pontoon 110. Bias mechanism 165 may comprise a flexible bias rod 166 coupled to buoyant body 110 and to a fixed point on a bias shaft 167. Bias shaft 167 is associated with front hydrofoil assembly 150 such that pivoting of front hydrofoil assembly 150 results in pivoting of bias shaft 167, and vice versa.

DETAILED DESCRIPTION

Operation

Like all sailboards, the watercraft of this embodiment is operated with the sail leaning to windward to balance against the lateral force of the wind. The lack of lateral pivotability of joint 124 results in tilting of pontoon 110, rear hydrofoil 140, rear strut 142, and front hydrofoil assembly 150 along with the sail. This produces an effect similar to that of a sail tilting independently from a conventional board. If joint 124 were a universal joint of the kind normally used in windsurfing, the hydrofoils and their supporting structures would not provide sufficient lateral resistance, and the amount of tilting of the watercraft would be difficult to control. Thus the lack of lateral pivotability of joint 124 makes balancing on the hydrofoil-equipped sailboard easier than it would be with a universal joint.

Steering of the wind-powered personal hydrofoil watercraft of this embodiment may be achieved by tilting sail 120 toward the front or back of pontoon 110. This redistributes the lateral force of the wind toward the front or back of pontoon 110, and the imbalance of lateral force causes pontoon 110 to turn. The turning is possible because of the side-to-side pivotability of front hydrofoil assembly 150, and because the configuration of front strut 162 to the rear of the turning axis of front hydrofoil assembly 150 allows front hydrofoil assembly to swivel without accidentally turning to face backward. The presence of the hydrofoils allows an additional steering method wherein steering mechanism 170, actuated by the user's feet, directly causes pivoting or turning of front hydrofoil assembly 150. When front hydrofoil assembly 150 is in a pivoted or turning state, the resultant turning of bias shaft 167 causes bending of bias rod 166. Bias rod 166 resists bending and naturally tends to straighten, resulting in turning of front hydrofoil assembly 160 to achieve a non-pivoted orientation. This implementation of bias mechanism 165 allows for adjustment of the stiffness of the bias by changing the distance between bias shaft 167 and the point at which bias rod 166 is coupled to buoyant body 110. However, it should be recognized that many other implementations of bias mechanism 165 are possible without departing from the present invention.

Steering can be also achieved by vertically pivoting the rear strut or the rear hydrofoil assembly. The vertically pivoting can be also actuated by tilting sail toward front or back and steering mechanism 170, actuated by the user's feet by using steering mechanism operated by the user's feet or hands.

Although the description above contains many specificities, these should not be construed as limiting the scope of the embodiments but as merely providing illustrations of some of the presently preferred embodiments.

Thus the scope of the embodiments should be determined by the appended claims and their legal equivalents, rather than by the examples given.

The invention claimed is:

1. A hydrofoil windsurfer comprising:

a buoyant body for supporting a single, standing human user;

a sail for propulsion;

a mast for supporting said sail;

a joint whereby said mast is coupled to said buoyant body, said joint allowing rotation of said mast on its own axis, and tilting of said mast in a vertical plane substantially aligned with the centerline of said buoyant body through a 180-degree range, but substantially prohibiting lateral tilting of said mast; and a front hydrofoil coupled to said buoyant body by means of a front strut and a rear hydrofoil coupled to said buoyant body by means of a rear strut, disposed so that they generate lift in a generally vertical direction;

whereby the lack of lateral tilting capability of said joint prevents said buoyant body from excessively rolling independently of said mast and said sail;

and further comprising a depth regulating means for automatically adjusting the depth of said hydrofoils beneath the surface of the water, said depth regulating means comprising a surface tracking body associated with said front hydrofoil and capable of adjusting the angle of attack of said front hydrofoil.

2. The hydrofoil windsurfer of claim 1 wherein at least one of said front strut and said rear strut is pivotable about a substantially vertical axis, and further comprising a steering mechanism actuated by at least one of said human operator's feet and hands, said steering mechanism being associated to at least one of said front strut and said rear strut such that actuation of said steering mechanism results in pivoting of said associated strut or struts.

3. The hydrofoil windsurfer of claim 2 wherein said steering mechanism comprises a steering rod, said steering rod being an elongated member capable of being pivoted by at least one of said human operator's feet, pivoting thereof being linked to corresponding pivoting of said associated strut or struts.

4. The hydrofoil windsurfer of claim 2 wherein said pivotable hydrofoil or hydrofoils are biased toward the original, non-pivoted orientation.

5. The hydrofoil windsurfer of claim 1 wherein at least one of said front strut and said rear strut is pivotable about a substantially vertical axis, each pivotable strut being disposed to the rear of said axis.

6. The hydrofoil windsurfer of claim 5 wherein said pivotable strut or struts are biased toward the original, non-pivoted orientation.

7. The hydrofoil windsurfer of claim 1 wherein said buoyant body is generally cylindrical, having a width comparable to its thickness.

* * * * *